US007603877B2

(12) United States Patent
Marioni

(10) Patent No.: US 7,603,877 B2
(45) **Date of Patent: *Oct. 20, 2009**

(54) DETECTING DEVICE OF UNBALANCE CONDITIONS PARTICULARLY FOR WASHING MACHINES AND SIMILAR HOUSEHOLD APPLIANCES, ACTIVATED BY A SYNCHRONOUS ELECTRIC MOTOR

(75) Inventor: Elio Marioni, Dueville (IT)

(73) Assignee: Askoll Holding S.r.l. (IT)

( * ) Notice: Subject to any disclaimer, the term of this patent is extended or adjusted under 35 U.S.C. 154(b) by 477 days.

This patent is subject to a terminal disclaimer.

(21) Appl. No.: 11/360,316

(22) Filed: Feb. 23, 2006

(65) Prior Publication Data

US 2006/0191337 A1 Aug. 31, 2006

(30) Foreign Application Priority Data

Feb. 25, 2005 (EP) ..... 05425101

(51) Int. Cl.
*D06F 33/00* (2006.01)
*D06F 37/30* (2006.01)
*H02K 7/00* (2006.01)

(52) U.S. Cl. ..... 68/12.06; 68/12.27; 68/140; 310/67 R

(58) Field of Classification Search ..... 68/12.06, 68/12.16, 12.17, 12.27, 23 R, 23.1, 140; 310/67 R, 310/64

See application file for complete search history.

(56) References Cited

U.S. PATENT DOCUMENTS

| | | | | |
|---|---|---|---|---|
| 4,590,801 | A * | 5/1986 | Merhav | 73/510 |
| 5,783,881 | A * | 7/1998 | Best et al. | 310/68 C |
| 6,477,867 | B1 * | 11/2002 | Collecutt et al. | 68/12.06 |
| 6,725,136 | B2 * | 4/2004 | Lutz et al. | 701/29 |
| 6,836,036 | B2 * | 12/2004 | Dube | 310/64 |
| 2002/0194682 | A1 | 12/2002 | Conrath | |
| 2006/0208582 | A1 * | 9/2006 | Marioni | 310/68 R |

FOREIGN PATENT DOCUMENTS

| | | | |
|---|---|---|---|
| EP | 0 682 396 | A2 | 11/1995 |
| EP | 1 167 609 | A1 | 1/2002 |
| WO | WO 2004/111324 | A1 | 12/2004 |

* cited by examiner

*Primary Examiner*—Joseph L Perrin
(74) *Attorney, Agent, or Firm*—Akerman Senterfitt

(57) ABSTRACT

A detecting device of unbalance conditions, particularly for washing machines (1) and similar household appliances comprising a rotary drum (2*a*) supported by a tank (2) and activated by a synchronous electric motor (3) with an internal stator (5) having corresponding windings fixedly mounted on a central axis (10). The detecting device comprises an electronic control board (18) for the synchronous motor (3) associated with the stator (5) and incorporating at least one accelerometer (51) to constantly monitor the acceleration of said tank (2) and indirectly the unbalance of said washing machine (1) and the unbalance of a load comprised in the rotary drum (2*a*).

24 Claims, 3 Drawing Sheets

DETECTING DEVICE OF UNBALANCE CONDITIONS PARTICULARLY FOR WASHING MACHINES AND SIMILAR HOUSEHOLD APPLIANCES, ACTIVATED BY A SYNCHRONOUS ELECTRIC MOTOR

FIELD OF APPLICATION

The present invention relates to a detecting device of unbalance conditions particularly for washing machines and similar rotary-drum household appliances activated by a synchronous electric motor.

In particular, this invention relates to a device being capable of continuously detecting the load unbalance in washing machines, washers and similar household appliances, wherein the drum is rotation-operated by a permanent-magnet synchronous electric motor.

PRIOR ART

As it is well known to the skilled in the art, washing machines for domestic use are equipped with a rotary drum, inserted in a tank and connected thereto by means of springs and shock absorbers, rotation-operated by an electric motor.

An electronic control board electrically connected to a washing machine main board allows the electric motor operation to be regulated both in the start-up step and during all the different operating steps: washing, rinsing, spin-drying, etc.

In the case of the present invention, the electric motor is of the permanent-magnet synchronous type comprising an internal stator having stator windings fixedly mounted on a central axis and an external cup-like rotor surrounding the stator. The washing machine rotary drum is kinematically connected to the synchronous motor rotor by means of suitable pulleys and a driving belt and it comprises a variable load both for the mass and for the space arrangement inside the drum.

Obviously, the variation or better the resultant of the load unbalance during some operating steps of the washing machine, particularly during the rinsing and high-motor-rotation spin-drying step, lets the tank undergo inertial acceleration forces.

These inertial forces are obviously transferred to the washing machine structure and, if uncontrolled, they can cause undesired vibrations as well as improper and bothersome displacements of the machine itself.

In general, in a washing machine, the electric motor, the corresponding electronic control board and the device for determining possible load unbalances are arranged in positions being spaced from each other.

In practise, the electric motor is positioned in a washing machine lower portion, the electronic board is arranged in a separated area near the main board and it is connected to the electric motor by means of specific wire assemblies, while a device for determining the load unbalance resultant is positioned near the rotary drum and it is connected in turn to the electronic control board by means of suitable wire assemblies.

The separation between the electronic board and the motor is mainly due to the internal-rotor motor configuration wherein the statoric part serves as a connection to the washing machine tank structure and thus it does not allow a supporting function also for the motor control electronics to be performed.

However, this separation requires a complex and expensive wire assembly to connect both the electronic board with the corresponding electric motor and the device for determining the load unbalance resultant with the electronic board controlling it.

The high wire assembly being required obviously involves higher electric motor maintenance costs in case of failure.

Some solutions are already known to determine possible unbalances of the load in the rotary drum, such as for example the teachings comprised in the U.S. Pat. No. 5,677,606, concerning a method for determining the unbalance of a load according to the current absorbed by the motor, or from the method described in the US patent application no. US2002/0035757. Nevertheless, these methods refer to universal motors and not specifically to synchronous electric motors and the indicated methods are particularly complex and not easily determinable. Further known solutions provide the positioning of an accelerometer on the tank. As it is known, the accelerometer is an analogue sensor providing an output voltage being proportional to an inertial force generally exerted on a small mass hanging from a flexible support integral with the sensor envelope.

However, these known solutions have some drawbacks, in fact they require the use of detecting devices positioned near the rotary drum and they require amplifiers and suitable circuits to process the output voltage as well as suitable wire assemblies to connect these devices to the electronic control board.

A further disadvantage of known devices is due to the fact that the measure is sometimes not completely reliable and the results being provided are not very precise also due to the noises induced on the connecting wire assembly between the accelerometer and the electronic control board.

A further disadvantage is represented by the cost of the connecting wire assemblies and of the labour required for the correct assembly thereof.

Known solutions are thus not completely satisfactory in terms of costs and/or provided performances.

According to one aspect to the present invention is therefore to provide a detecting device of unbalance conditions particularly for washing machines and similar household appliances activated by a synchronous electric motor, having such a structure and functionality as to allow the washing machine acceleration to be continuously detected with sufficient accuracy in order to prevent possible oscillations, noise and shakes of the whole washing machine structure as well as possible operation irregularities. The device should also allow an important reduction of the connecting wire assemblies to the control board, and of the same to the motor, a considerable cost saving, both of the materials and of the labour providing an extremely compact device.

SUMMARY OF THE INVENTION

An embodiment to the present invention provides an electronic control board, connected to the synchronous electric motor stator and supported thereby, incorporating an accelerometer to constantly detect the washing machine tank acceleration.

One aspect to the device according to the present invention allows the motor speed to be controlled in order to drastically reduce the vibrations and oscillations, of the drum and of the household appliance itself, due to an unbalance of the load in the drum, as well as the undesired effects of these vibrations such as: noise, shakes and operation irregularities.

Advantageously according to another aspect to the invention a piezoelectric-film accelerometer is used.

Further features and advantages of the device according to the invention will be apparent from the following description of an embodiment with reference to the attached drawings given by way of indicative and non limiting example.

DETAILED DESCRIPTION

Figure 1:
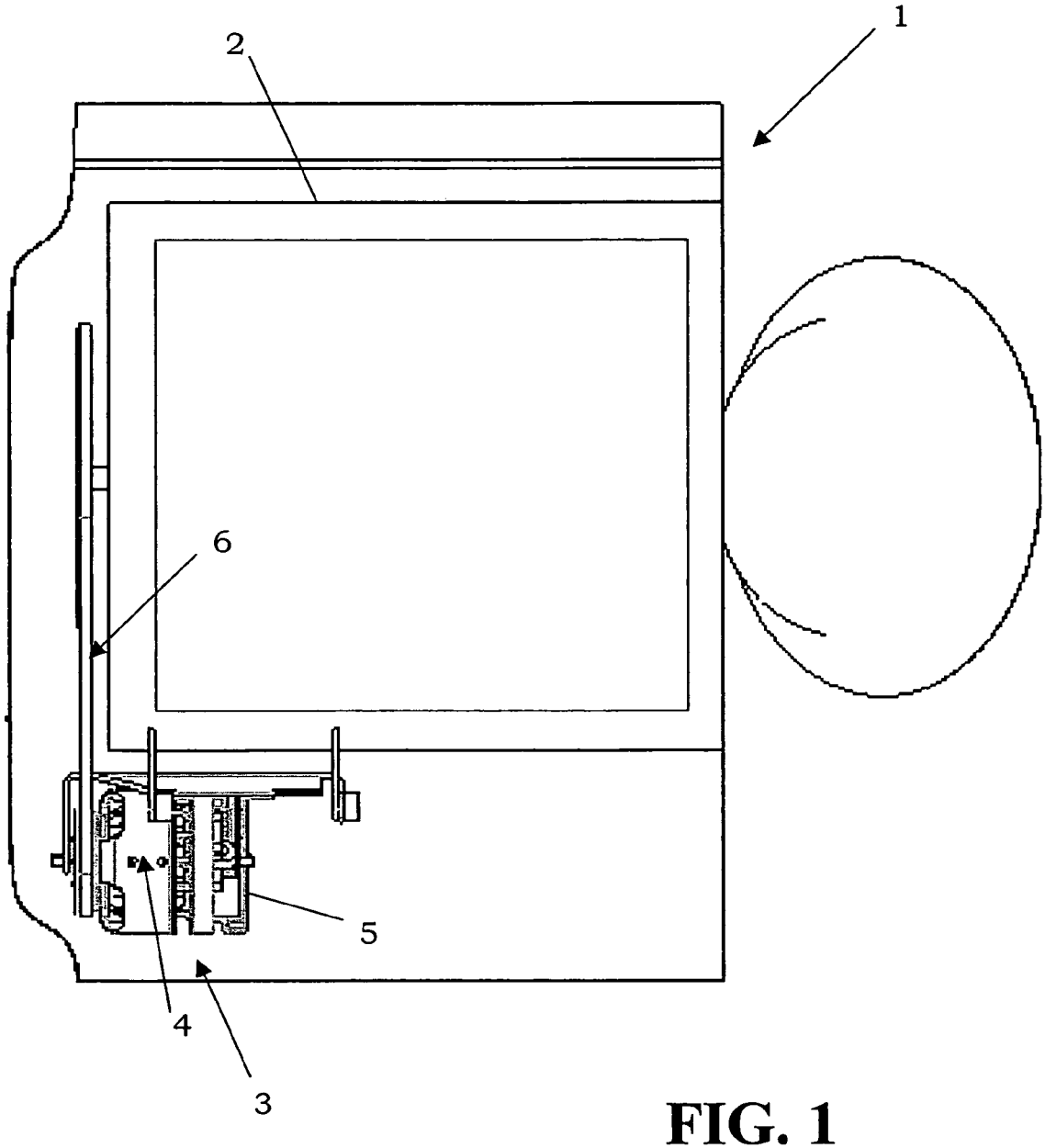
FIG. 1 schematically shows a washing machine incorporating a synchronous electric motor.

With reference to FIG. 1, a washing machine with a rotary drum 2*a*, supported by means of springs and shock absorbers by a tank 2 is schematically represented with 1, for which a permanent-magnet synchronous electric motor 3 is used, equipped with a device 50, according to an embodiment of the present invention.

The electric motor is of the so-called internal-stator and external-rotor type, i.e. of the type wherein the rotor 4 is mounted outside the corresponding stator 5.

In the case of the solution being shown, the synchronous electric motor 3 is kinematically connected in a traditional way to the rotary drum 2*a* of the washing machine 1 by means of a belt pulley connection 7 which can be seen in FIG. 1.

Moreover, the synchronous electric motor 3 is supported by the tank 2 by means of suitable locking means 70 such as for example one or more brackets. In a fully traditional way, the tank 2 is thus connected to the external structure of the washing machine 1.

Figure 4:
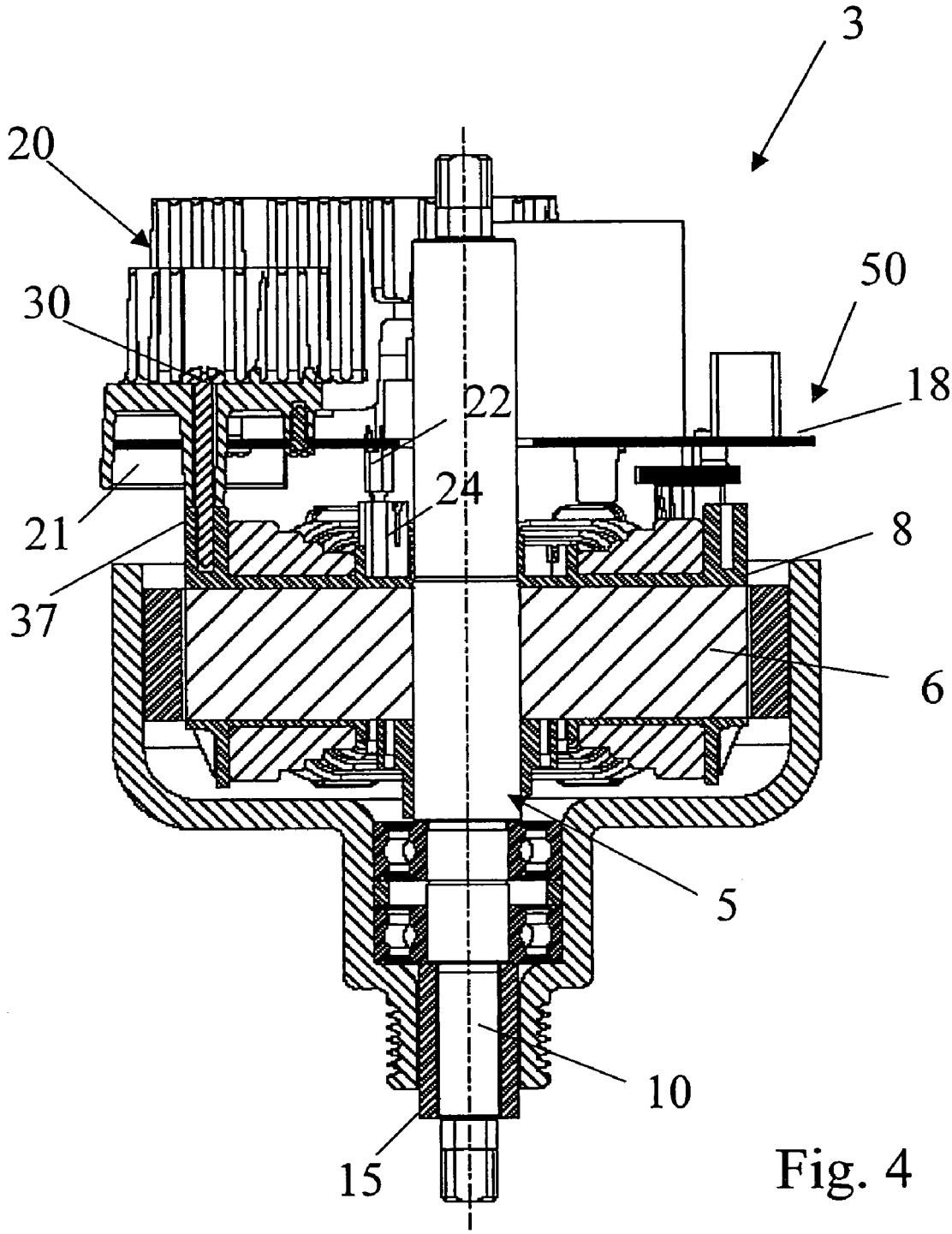
FIG. 4 is a section of the electric motor of FIG. 2.

On the whole, the internal stator 5 of the synchronous electric motor 3 has a substantially cylindrical configuration and it comprises a plurality of known pole pieces 6 each of them being defined by a corresponding plurality of equal plates, packed the one onto the other, in mutual contact, as emphasised in FIG. 4.

The stator 5 traditionally has an axial passage 15, which is also substantially cylindrical, with a predetermined diameter, or prismatic, and intended to be engaged by an axis 10.

The synchronous electric motor 3 comprises the device 50 electrically connected to the motor itself, which is, in the present embodiment, made integral with an heat sink element 20 associated with the device 50 which has a blade-like configuration with a wide thermal exchange surface.

Advantageously, according to the present invention, the device 50 comprises an electronic control board 18 for the synchronous motor 3 suitably supported by the stator 5 by means of an axial extension thereof. According to the embodiment shown in FIGS. 2 and 4, the electronic board 18 is housed in a recess 21 obtained on the heat sink element 20 side turned towards the stator 5.

Moreover, in a preferred embodiment, in order to obtain the electric connection between the electronic board 18 and the stator 5, the synchronous electric motor 3 comprises first connecting elements 22 of the board 18 projecting towards the stator 5 and second connecting elements 24 of the stator 5 projecting towards the board 18.

In the case of the solution being shown, the first and second connectors 22 and 24 respectively are connectors of the male/female fast-clutch type, such as for example fastom connectors.

Figure 2:
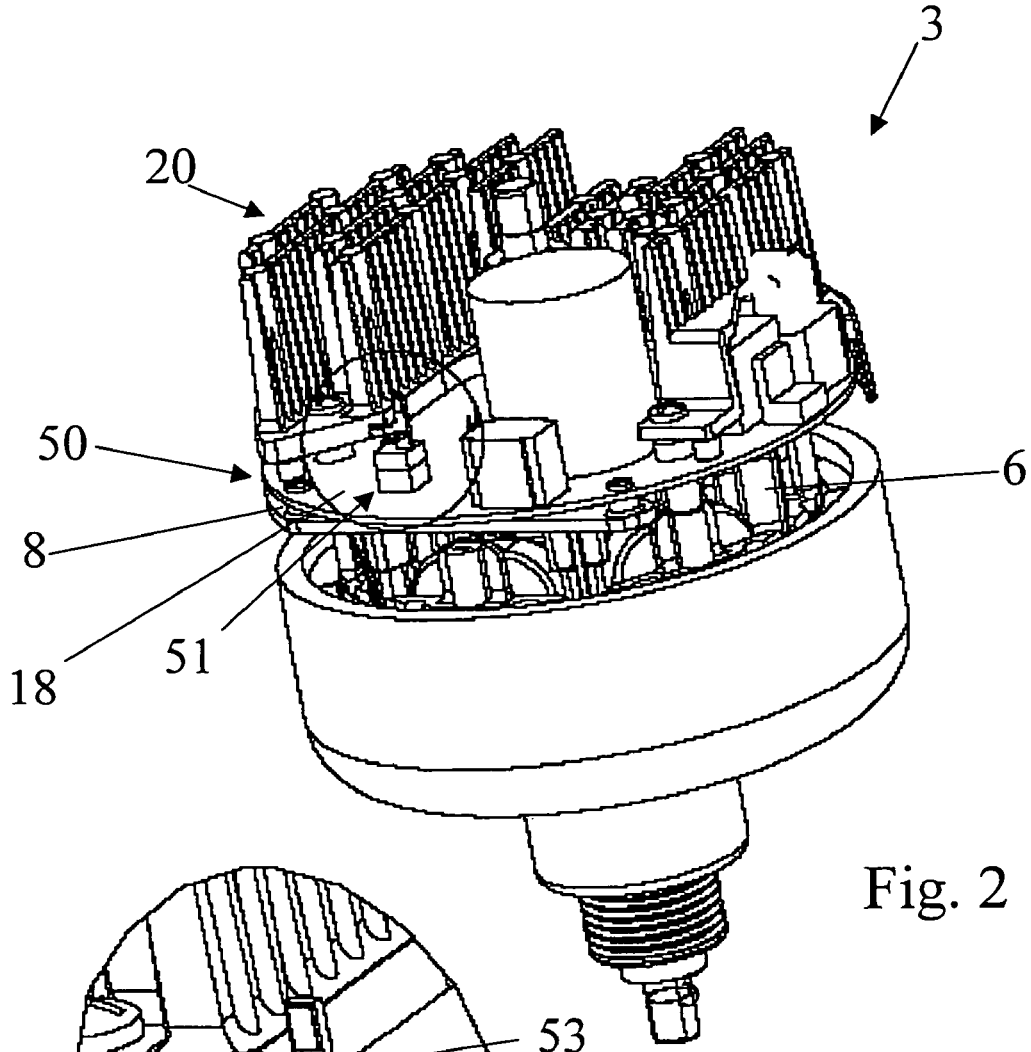
FIG. 2 is a three-quarter view of a synchronous electric motor comprising a device according to the present invention.

Advantageously, the electronic board 18 of the device 50, as highlighted in FIG. 2, incorporates at least one accelerometer 51 connected to the tank 2 by means of a fast connector connection and intended to constantly monitor the acceleration or better the inertial acceleration forces of the tank 2 generated by a resultant of the load unbalance forces in the rotary drum 2*a*. In an indirect way, this measure allows a load unbalance in the rotary drum 2*a* to be determined.

The accelerometer 51 in the electronic board 18, associated with the stator 5, also allows the unbalance of the electronic board 18 as well as of the whole washing machine 1 to be indirectly determined, the synchronous electric motor 3 and thus the stator 5 being substantially integral with the tank 2 thanks to the locking means 70 and the tank 2 with the structure of the washing machine 1 by means of the usual connections.

In greater detail, the heat sink 20 is directly fixed on the frame 8 of the stator 5 by means of clamping screws 30. Preferably the clamping screws 30 can be screwed from outside the electric motor 3, in suitable internally-hollow bushes 37, so as to favour fixing operations.

Obviously, other and different solutions can be realised to associate the electronic board 18 with the stator 5 and with the heat sink 20.

Figure 3:
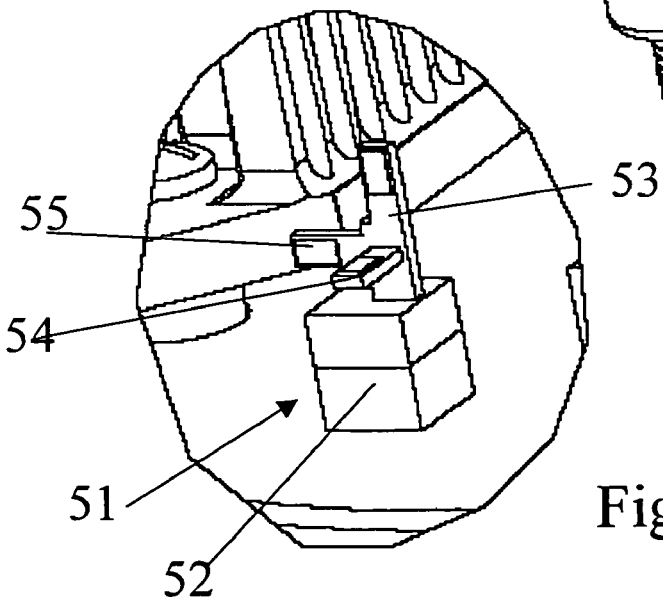
FIG. 3 shows a detail of the device of FIG. 2.

Advantageously, in the shown embodiment, the accelerometer 51 in the electronic board 18 is of the piezoelectric-film type with detections on three axes. More particularly, as highlighted in FIG. 3, the three-axis accelerometer 51 has three arms 53, 54 and 55 oriented according to three space directions X, Y and Z, each arm being composed of an uniaxial accelerometer of the piezoelectric-film type.

The three arms 53, 54 and 55 are associated with a central body 52.

The central body 52 internally comprises at least one integrated circuit allowing the signals coming from each of the three arms 53, 54 and 55 to be processed in order to generate an output signal being proportional to the force exerted in correspondence with the ends of the three arms.

The corresponding acceleration is mathematically obtained according to the well known laws of physics.

Preferably, the central body 52 is integrally and electrically connected to the electronic board 18 and it has the arm 53 extended according to the direction X arranged perpendicularly to the electric board 18 itself.

Obviously the accelerometer 51 can be also of the bidirectional or monodirectional type comprising two or only one piezoelectric-film accelerometer respectively, or it can be of the piezoresistive type or even of the capacitive-variation type, also called tunnel effect. The accelerometer 51, according to the patterns being used, provides one or more output signals which, applied and suitably processed by the electronic board 18, allow the operation of the synchronous electric motor 3 to be suitably modified, thus controlling the inertial forces of the tank 2. For example, following the output signal, a correction signal of the speed of the synchronous electric motor 3 or an alarm or stop signal can be generated according to the requirements and functionality of the washing machine 1 itself.

The continuous monitoring of the accelerometer 51 on the tank 2 and a continuous control on the output signal of the accelerometer 51 itself allow vibrations, noise as well as the improper and bothersome displacements of the washing machine 1 to be avoided in the bud.

Obviously different solutions of the present invention can be provided, for example by using two accelerometers 51 positioned on the electronic board 18, one for detecting the acceleration forces of the tank 2 and one for accelerating the electronic board 18 and thus the structure of the washing machine 1.

The main advantage of the detecting device of unbalance conditions according to the invention is that it allows the inertial acceleration forces of the washing machine tank (2) to be constantly and continuously monitored directly by an accelerometer positioned on the electronic board associated with the stator of a synchronous electric motor. A further advantage is due to the reduced wire assemblies that the solution being shown involves both for the easy connection of the electronic control board to the stator and for the accelerometer being directly on the electronic board and this involves a limited-cost realisation as well as a reduced and an improved signal detection.

Moreover, due to the fact that the accelerometer allows the displacements of the electronic board to be detected and being the latter tightly integral with the stator and with the tank due to the locking means 70, it allows the washing machine displacements to be detected providing an electric signal which can be effectively used to avoid vibrations and noise in the bud.

A further advantage is due to the fact that by using an accelerator being directly arranged on the electronic board and the latter being associated with the synchronous motor stator an extremely compact, functional device is realized at extremely reduced costs.

The invention claimed is:

1. A detecting device for detecting imbalance conditions of a rotary drum of a washing machine having the rotary drum supported by a tank and activated by a synchronous electric motor, the synchronous electric motor comprising an internal stator having corresponding windings fixedly mounted on a central axis and an external rotor, wherein the detecting device comprises:

an electronic control board for the synchronous electric motor supported by the stators; and at least one accelerometer to constantly monitor the accelerations of the tank, wherein said accelerometer is fixed on top of said electronic control board.

2. The device according to claim 1, wherein the synchronous electric motor is associated with the tank by locking means and wherein the electronic control board, having the at least one accelerometer associated with the stator, allows an indirect monitoring of the imbalance of the washing machine and an imbalance of a load contained in said rotary drum.

3. The device according to claim 2, wherein the locking means have at least one bracket.

4. The device according to claim 1, wherein the at least one accelerometer produces at least one electric signal processed by the electronic control board and is used to drive the synchronous electric motor.

5. The device according to claim 1, wherein the at least one accelerometer is a monodirectional accelerometer allowing a monitoring of the displacement of the tank and/or of the electronic control board with respect to a spatial direction referring to the central axis.

6. The device according to claim 1, wherein the at least one accelerometer is a bidirectional accelerometer allowing a monitoring of the displacement of the tank and/or of the electronic control board with respect to a pair of spatial directions referring to the central axis.

7. The device according to claim 1, wherein the at least one accelerometer is a three-dimensional accelerometer allowing a monitoring of the displacement of the tank and/or of the electronic control board with respect to three orthogonal directions, one of which is coaxial to the central axis.

8. The device according to claim 1, wherein the electronic control board has first connecting elements projecting towards the stator to be coupled by quick coupling with second connecting elements of the stator projecting towards the electronic control board.

9. The device according to claim 8, wherein the first and second connecting elements are male/female type connectors.

10. The device according to claim 1, wherein the electronic control board is supported by a heat sink associated above the stator.

11. The device according to claim 10, wherein the electronic control board is housed in a recess provided on a side of the heat sink element facing the stator.

12. The device according to claim 10, wherein the heat sink element has clamping screws which can be screwed from outside the electric motor in opposite hollow bushes internally provided on a frame of the stator.

13. A washing machine having a detecting device for imbalance conditions of a rotary drum, comprising:

a rotary drum supported by a tank and activated by a synchronous electric motor;

the synchronous electric motor comprising an internal stator and an external rotor, the internal stator having corresponding windings fixedly mounted on a central axis;

wherein the detecting device has an electronic control board for the synchronous electric motor supported by the stator and at least one accelerometer to constantly monitor the accelerations of the tanks, wherein said accelerometer is fixed on top of said electronic control board.

14. The washing machine according to claim 13, wherein the synchronous electric motor is associated with the tank by locking means and wherein the electronic control board, having the at least one accelerometer associated with the stator, allows an indirect monitoring of the imbalance of the washing machine and an imbalance of a load contained in the rotary drum.

15. The washing machine according to claim 14, wherein the locking means have at least one bracket.

16. The washing machine according to claim 13, wherein the at least one accelerometer produces at least one electric signal processed by the electronic control board and used to drive the synchronous electric motor.

17. The washing machine according to claim 13, wherein the at least one accelerometer is a monodirectional accelerometer allowing a monitoring of the displacement of the tank and/or of the electronic control board with respect to a spatial direction referring to the central axis.

18. The washing machine according to claim 13, wherein the at least one accelerometer is a bidirectional accelerometer allowing a monitoring of the displacement of the tank and/or of the electronic control board with respect to a pair of spatial directions referring to the central axis.

19. The washing machine according to claim 13, wherein the at least one accelerometer is a three-dimensional accelerometer allowing a monitoring of the displacement of the tank and/or of the electronic control board with respect to three orthogonal directions, one of which is coaxial to the central axis.

20. The washing machine according to claim 13, wherein the electronic control board has first connecting elements projecting towards the stator to be coupled by quick coupling with second connecting elements of the stator projecting towards the electronic control board.

21. The washing machine according to claim 20, wherein the first and second connecting elements are male/female type connectors.

22. The washing machine according to claim 13, wherein the electronic control board is supported by a heat sink associated above the stator.

23. The washing machine according to claim 22, wherein the electronic control board is housed in a recess provided on a side of the heat sink element facing the stator.

24. The washing machine according to claim 22, wherein the heat sink clement has clamping screws which can be screwed from outside the electric motor in opposite hollow bushes internally provided on a frame of the stator.

* * * * *